US005187919A

United States Patent [19]

Guardiola

[11] Patent Number: 5,187,919

[45] Date of Patent: * Feb. 23, 1993

[54] PROCESS FOR FILLING CONTAINERS WITH PRODUCTS IN A PREDETERMINED DISTRIBUTION

[75] Inventor: Agustin D. Guardiola, Badalona, Spain

[73] Assignee: Talleres Daumar S.A., Badalona, Spain

[ * ] Notice: The portion of the term of this patent subsequent to Mar. 17, 2009 has been disclaimed.

[21] Appl. No.: 633,064

[22] Filed: Dec. 20, 1990

[30] Foreign Application Priority Data

Dec. 27, 1989 [ES] Spain ..... 9000187

[51] Int. Cl.[5] ..... B65B 5/10; B65B 39/14

[52] U.S. Cl. ..... 53/443; 53/475; 414/788.9; 414/790.9; 414/793

[58] Field of Search ..... 53/154, 237, 246, 250, 53/251, 244, 255, 263, 534, 543, 443, 467, 475, 474; 414/788.9, 789.1, 792.9, 793, 744.3, 790.9

[56] References Cited

U.S. PATENT DOCUMENTS

| | | | |
|---|---|---|---|
| 2,685,994 | 8/1954 | Haumiller et al. | 53/244 |
| 2,938,315 | 5/1960 | Voullaire | 53/475 |
| 3,553,926 | 1/1971 | Zwiacher et al. | 53/475 X |
| 3,951,274 | 4/1976 | Yamamoto | 53/244 X |
| 4,096,683 | 6/1978 | McMickle, Jr. | 53/244 |
| 4,194,343 | 3/1980 | Myers et al. | 53/244 X |
| 4,235,065 | 11/1980 | Freeman | 53/474 X |
| 4,435,941 | 3/1984 | Booth et al. | 53/474 X |
| 4,446,670 | 5/1984 | Compagnoni | 53/244 |
| 4,694,637 | 9/1987 | Bech et al. | 53/443 X |
| 4,722,169 | 2/1988 | Desantis | 53/475 X |
| 4,915,368 | 4/1990 | Tsunekawa | 53/246 X |
| 4,974,391 | 12/1990 | Blum et al. | 53/244 X |
| 5,095,680 | 3/1992 | Guardiola | 53/244 |

*Primary Examiner*—John Sipos
*Assistant Examiner*—Linda B. Johnson
*Attorney, Agent, or Firm*—Lackenbach Siegel Marzullo & Aronson

[57] ABSTRACT

A method for automatically filling a plurality of containers with products arranged therein in rows in one layer or a plurality of superposed layers in a pre-programmed geometric pattern. Empty containers are delivered in N rows to a container-filling station. The products to be contained in respective containers are automatically delivered one-by-one to supports equidistant from a vertical axis at the station. A vacuum suction is applied to the products on supports and they are raised above a level of the containers and held raised in fixed relative positions. While raised the products are rotated jointly about a vertical axis. Simultaneously during successive raisings of the products the containers are automatically positioned incrementally in a longitudinal direction and transversely thereof preparatory for lowering of the products vertically into the containers after each raising thereof. The containers are thus positioned in pre-programmed positions so that the individual rows are defined as the products are lowered and deposited in respective containers. During the filling of the containers barriers for constraining the products in rows are automatically lowered into the containers. The various operations are repeated in the above sequence until the containers are filled and they are then discharged from the container filling station.

4 Claims, 15 Drawing Sheets

PROCESS FOR FILLING CONTAINERS WITH PRODUCTS IN A PREDETERMINED DISTRIBUTION

The present invention relates to a process for filling containers with products, in a predetermined distribution, which contributes various advantages to be described below, apart from other advantages inherent therein and in its implementation.

SUMMARY OF THE INVENTION

Known are machines for filling containers and more specifically boxes (hence commonly called boxing machines) with diverse products, in particular fruits and certain vegetables. Among these machines some pick up and transport the products by the suction caused by vacuum, for which purpose they include devices provided with suction cups that are flexible in the degree required by the greater or lesser resistance of the surface of the products to be handled, to ensure maximum contact between the suction cups and the products, in order to limit losses of vacuum.

With said type of machines there are formed layers of fruits or other more or less round products in boxes or the like, in predetermined geometric arrangements normally designed so that the units of such products adjust themselves in each layer and so as to stabilize the content of the box with a view to its transportation and to obtain a good appearance at the point of sale, in case the product is offered directly with the box open for display to the buying public.

The process followed by the known machines is of the kind consisting in transferring by suction the products to be packed from their supply zones to their respective container, distributing them therein according to configurations provided in advance in one or more superposed layers, and transporting the empty containers from their entrance to the filling treatment to their exits when full; and lowering the container sufficiently each time to form each superposed layer, if any.

Also, in said known process the transfer of products is carried out by complete layers or by complete rows, which makes its execution difficult in that additional operations must be carried out to obtain the necessary variations required in the practice with respect to the different configurations of each layer and also of the layers among themselves, for better fitting and stabilization of the products in their boxes and to obtain a good visual appearance thereof at the points of sale.

If a complete layer is transferred each time, two transfer stations must be available for a single case, to be able to pack two different arrangements of superposed layers, complementary to each other, thereby obviously complicating the filling process and necessitating the adaptation of this part of the process with respect to its operative phases, in particular with respect to the necessity to make various adjustments for adapting the two transfers per box to the different spatial distributions of the fruits in their containers and to the various sizes of the latter, with the consequent delays for the necessary changes, with decreased output and with additional labor costs for the work of adaptation to the practical necessities. If a complete line of fruits is transferred, something similar occurs, with the disadvantages described.

The process for filling containers with products in a predetermined distribution, according to the invention, is of the kind consisting in transferring by suction the products to be packed from their supply zone to their respective container, distributing them therein in configurations provided in advance in one or more superposed layers, and transporting the empty containers from their entrance to the filling treatment to their exit when full. This process is characterized by transporting the products to be packed in a number N of independent rows, discharging the products of each row, one by one, into an individual support, these N supports lying in at least one peripheral arrangement and equidistant from each other, and transporting, separately in space and simultaneously, each of said N products —holding them temporarily by suction—from their respective supports and by an elevation, a rotation about a vertical axis of a value equal to the result of dividing each circumference into a number of parts equal to the quotient of 360° divided by 2N and multiplying it by the number of circumferences, and a descent, until they are deposited at the exact place of the row corresponding to the product layer being composed in the respective container of a number N of containers; by transporting the N containers until they are brought under the respective discharge action of the N products transported by suction and placing into each container a transverse barrier to delimit the space for composing each row of products; by composing the first row of products one by one, simultaneously in each of the containers and displacing the latter transversely step by step, in the same direction as the row and in the sense desirable for continuing to form it until it is completed; by holding said first completed row to immobilize it relative to its respective container and moving the N containers containing their first row of products forward longitudinally toward the exit, again bringing said containers under the action of said product discharges, the cycle repeating to form the second row, but with a transverse displacement of the containers in a direction opposite to that of the previous cycle, and after the second row of products is completed, the constraint of the first row is released and the second row is held down, and so forth until the respective layer of products is completed, at which time the described operations may be repeated for another layer or other superposed layers, raising to the appropriate height the barriers and means for holding the rows of products; and by controlling and regulating the spatial distribution of the products, both as to configuration of the necessary layer or layers of products and as to the relative arrangement of the layers in each container.

The process for filling containers with products in a predetermined distribution, according to this invention, avoids the mentioned disadvantages of the known processes, eliminating the additional operations thereof, and it brings, among others, the advantages deriving from its versatility with respect to being able to handle products and containers of different sizes and proportions, and with respect to being able to vary the spatial distribution of the products in their respective container, that is, the configuration of each layer of products and that of the layers among themselves, and all this in an easy, sure and quick manner.

The execution of the process for filling containers with products in a predetermined distribution, according to the present invention, brings the advantages described above, besides others which will be readily evident from the example of realization of said process, described in greater detail below, to facilitate the comprehension of the characteristics set forth above, various details of its execution being indicated at the same time, and for that purpose drawings are attached hereto in which a practical case of execution of the aforesaid process is represented by way of example only and without limiting the scope of the present invention.

In the drawings, a machine for filling containers with products in a predetermined distribution is represented which in its operation executes the process according to this patent and in one form of realization thereof.

DESCRIPTION OF THE PREFERRED EMBODIMENTS

Figure 1:
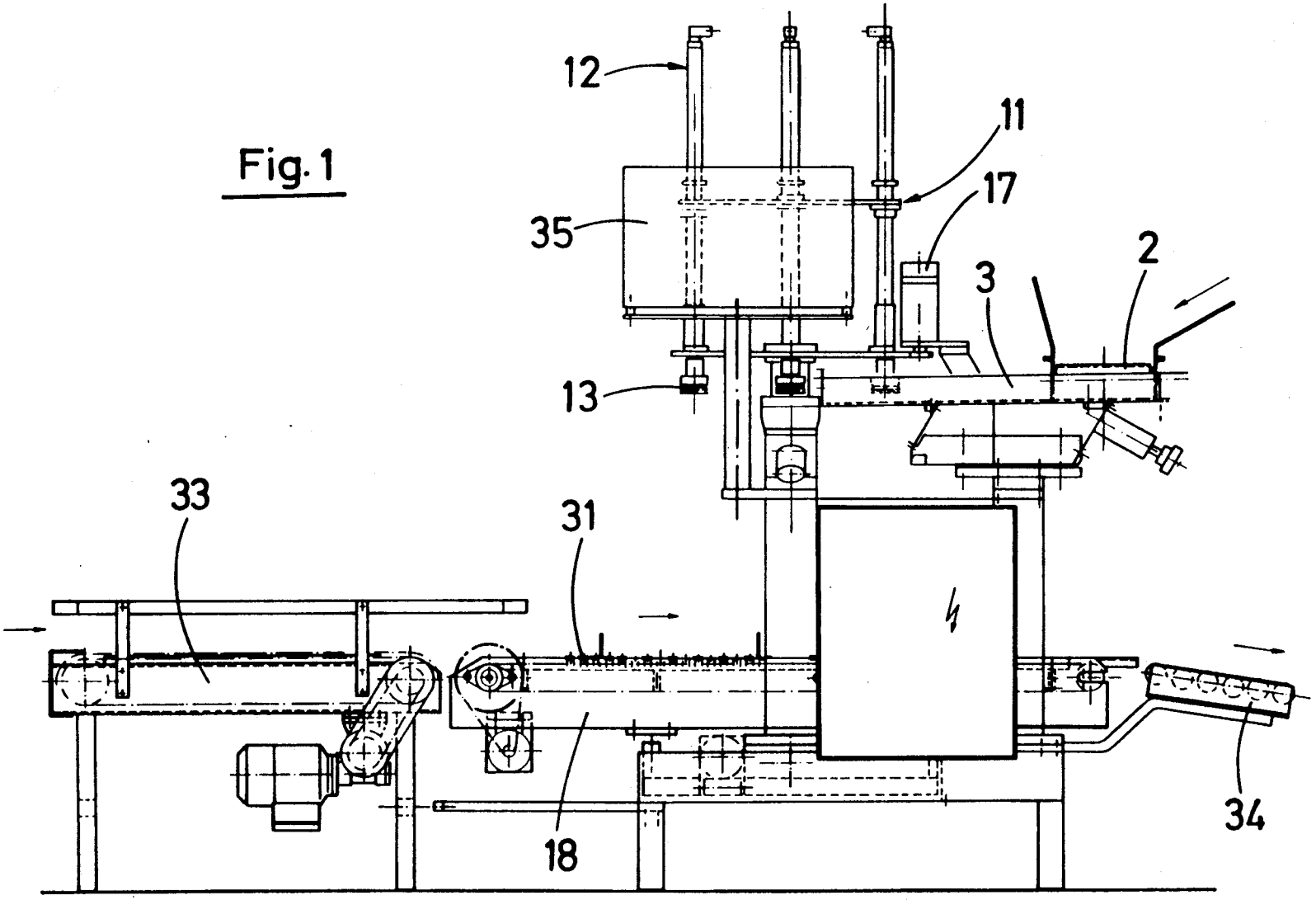
FIG. 1 shows in elevation the right side member of the machine.
Figure 2:
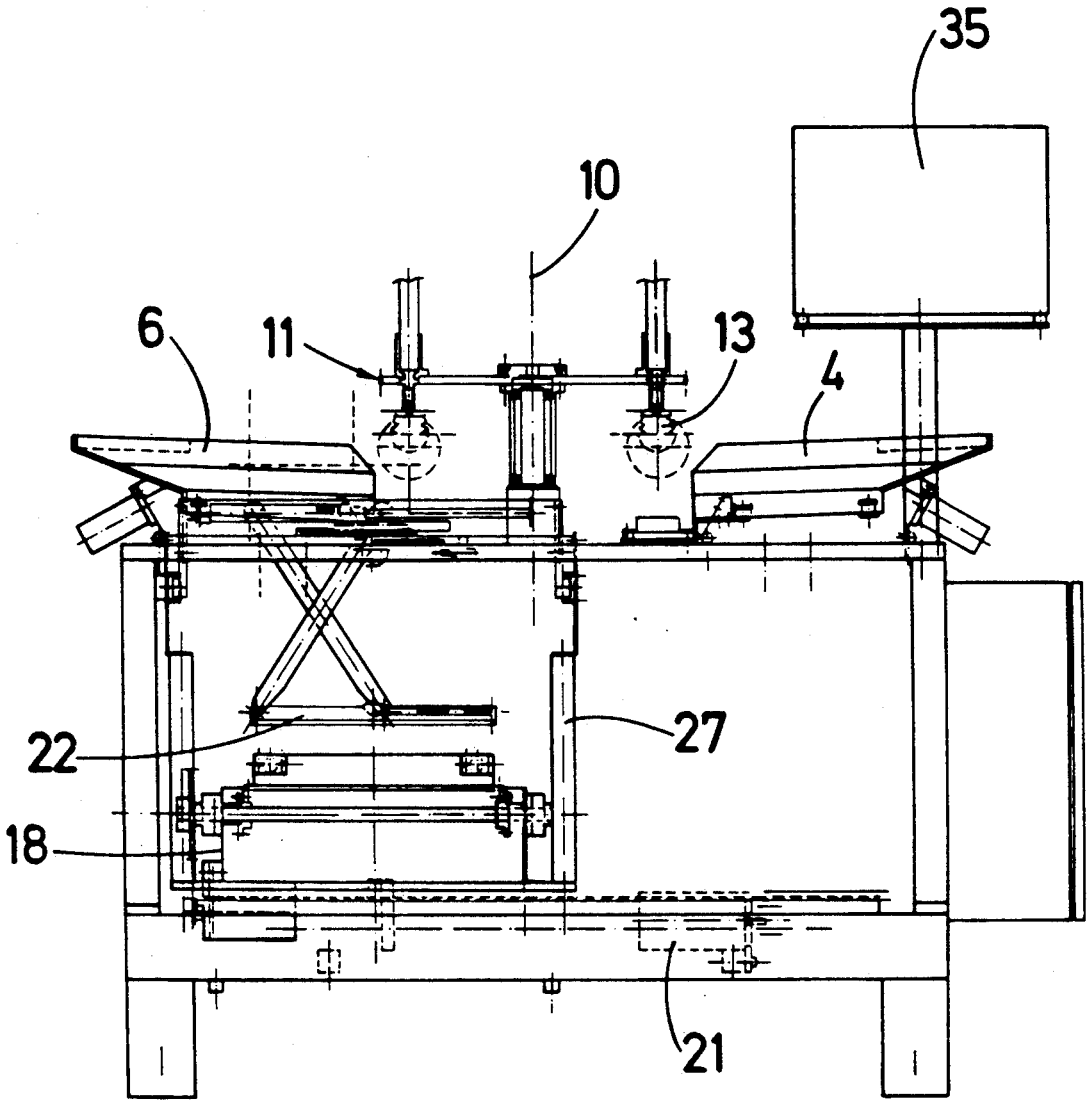
FIG. 2 is a front view thereof.
Figure 7:
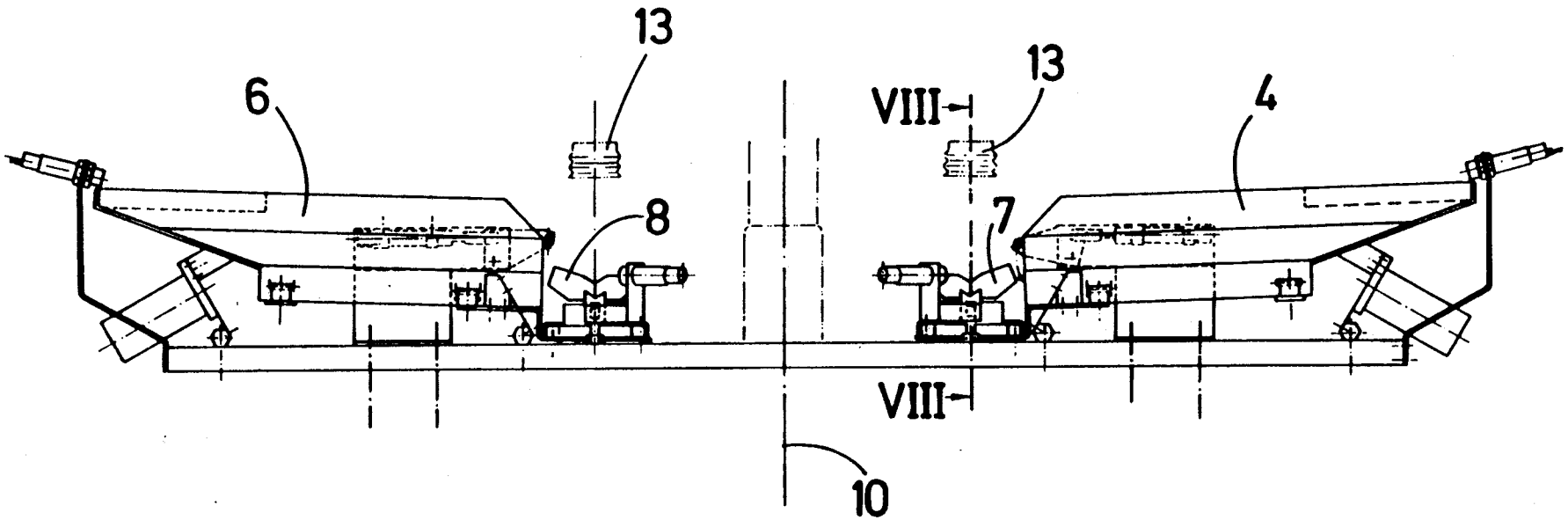
FIGS. 7 and 8 represent, respectively, a front view along the line A of FIG. 6 and a sectional view taken along the line VIII—VIII of FIG. 7.
Figure 8:
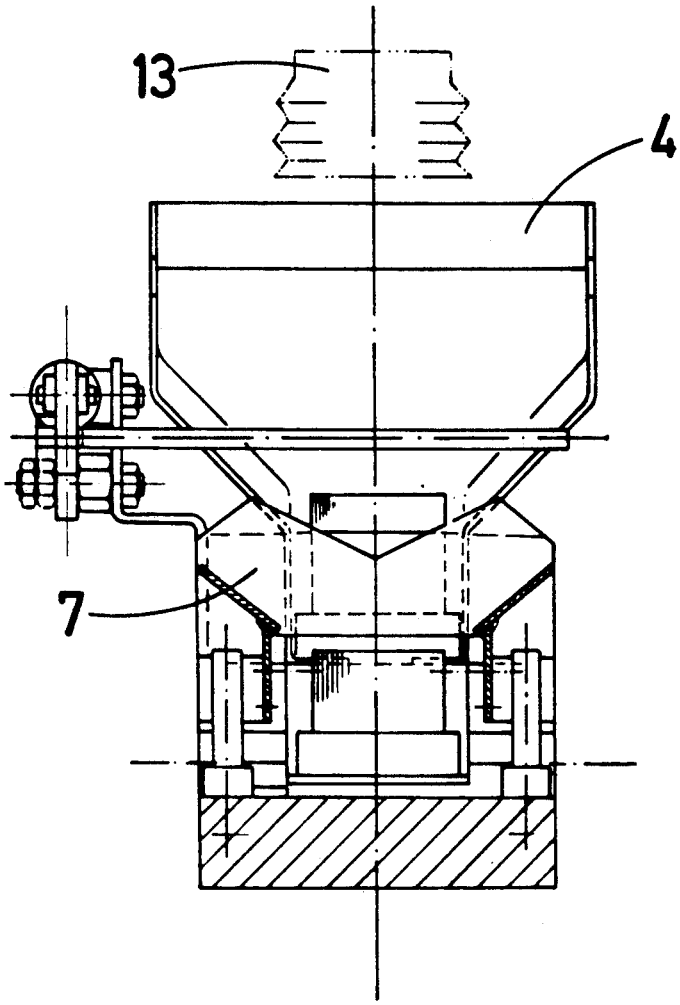

According to the process, the products to be packed are transported by transporting means—FIGS. 1, 2 and 4 to 8—which, in this example, are composed of the conveyor belts (1) and (2) and the vibratory ducts (3), (4), (5) and (6), in which ducts (4) and (6) the products are transported in as many independent rows, such products of each row being discharged one by one into a corresponding individual support (7) and (8), which supports are disposed along a diameter of an ideal circumference and equidistant from each other relative to the geometric center (9), through which a vertical geometric axis (10) passes—FIGS. 2 and 7—, and then each of said two products lying on the supports (7) and (8) is transported, separately in space and simultaneously, by means of a rotating frame (11)—FIGS. 1, 2, 9 and 10—which, in this example, comprises devices such as (12) for raising or lowering respective suction cups such as (13) and through which a suction is produced which causes the temporary constraint of the product on which said suction cup rests in its descent onto the product, lying, as has been said, on its respective individual support.

Figure 9:
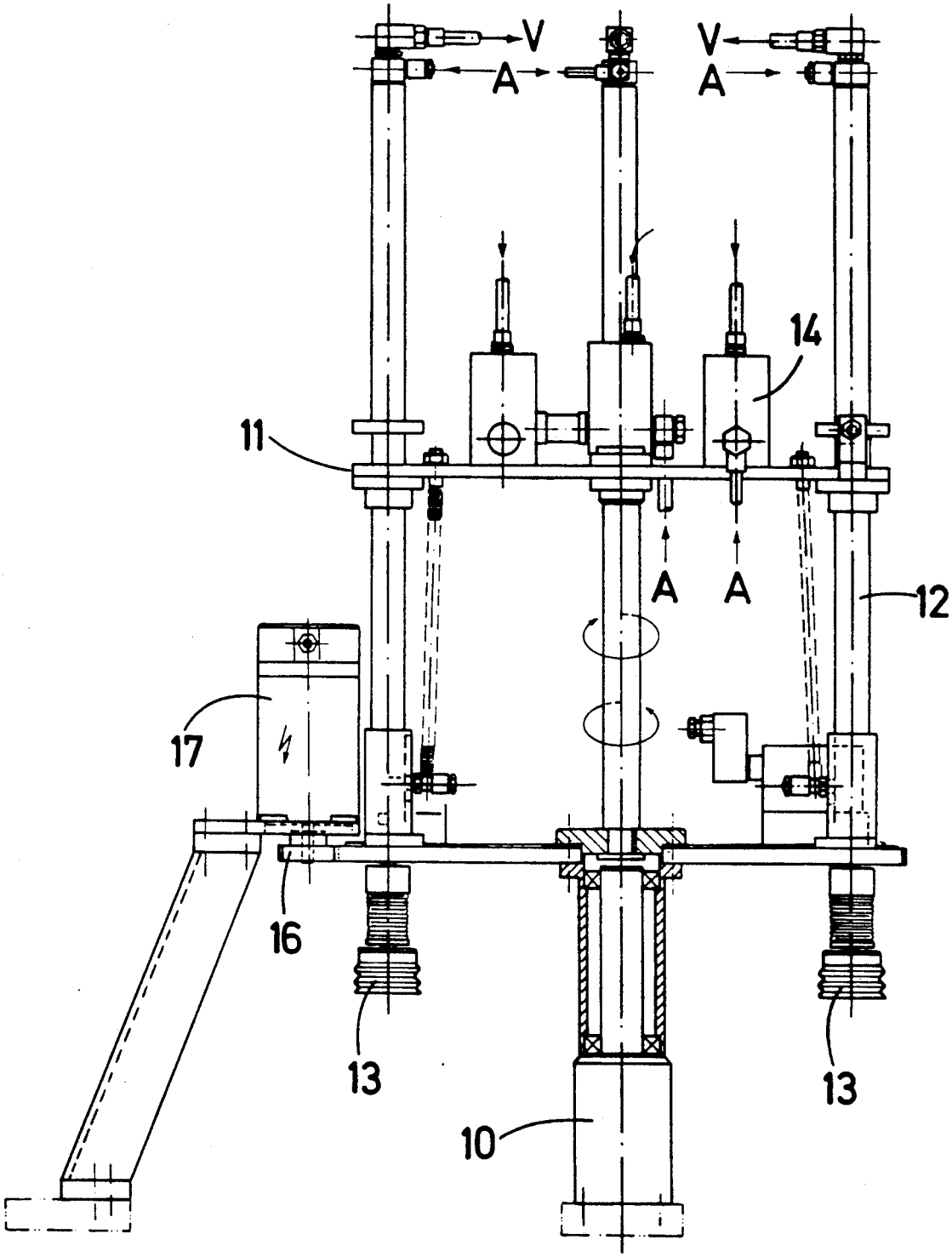
FIGS. 9 and 10 show, respectively, in elevation the left side member and a plan view of the product transporting means.
Figure 10:
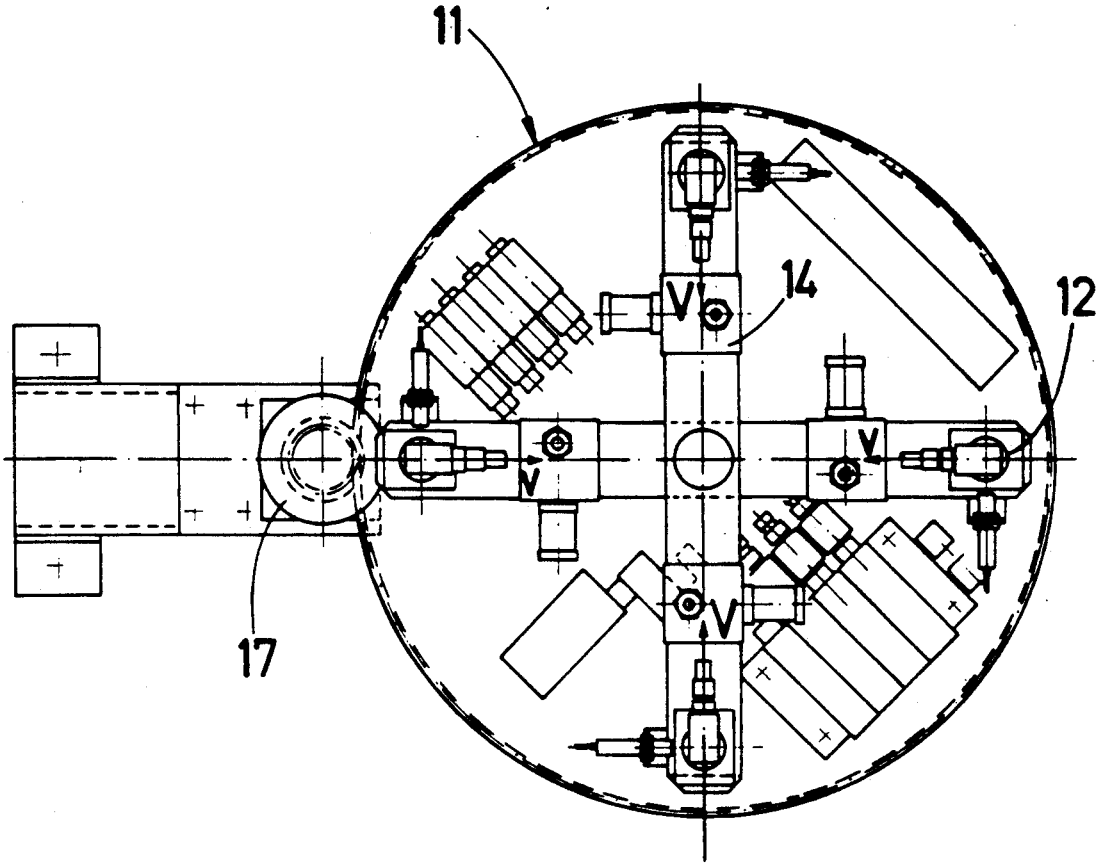

Said frame transports said pair, in this case, of products from their respective supports (7) and (8), raising them and making a rotation around the vertical axis (10) and lowering them until they are deposited in the predetermined place of the row corresponding to the product layer being formed in a respective container, two of them in this example, being filled simultaneously. In FIGS. 9 and 10 the letter A designates the entrance of compressed air, coming from a source of air under pressure, into the devices such as (12), while letter V designates the suction transmitted to each suction cup such as (13), which suction comes from a respective source of vacuum such as (14), which produces said suction by Venturi effect, being for that purpose connected to the compressed air system, although obviously said devices (12) and corresponding connections of compressed air and suction may be replaced by other adequate means and suitable sources of energy.

Frame (11) rotates owing to a corresponding mechanism, such as the one composed of the toothed rim (15), meshing with the pinion (16) of a step motor (17) and said rotation is of a value equal to the result of dividing each circumference, in this case one, into a number of parts equal to the quotient of 360° divided by twice the number of independent rows and multiplying it by the number of circumferences, in this case one, that is, the angle of rotation which the frame performs in each step equals 90° ($90° = 360°/2 \times 2$ independent rows $\times 1$ circumference).

The movement of the frame is preferably alternating with respect to direction of rotation, that is, one step in one direction and the next in the opposite direction, thereby simplifying the electric and pneumatic lines, but such movement could be step by step but in the same direction, in which case the electric connections as well as the pneumatic lines or the like should be adapted to permit said rotation in the same direction.

Figure 3:
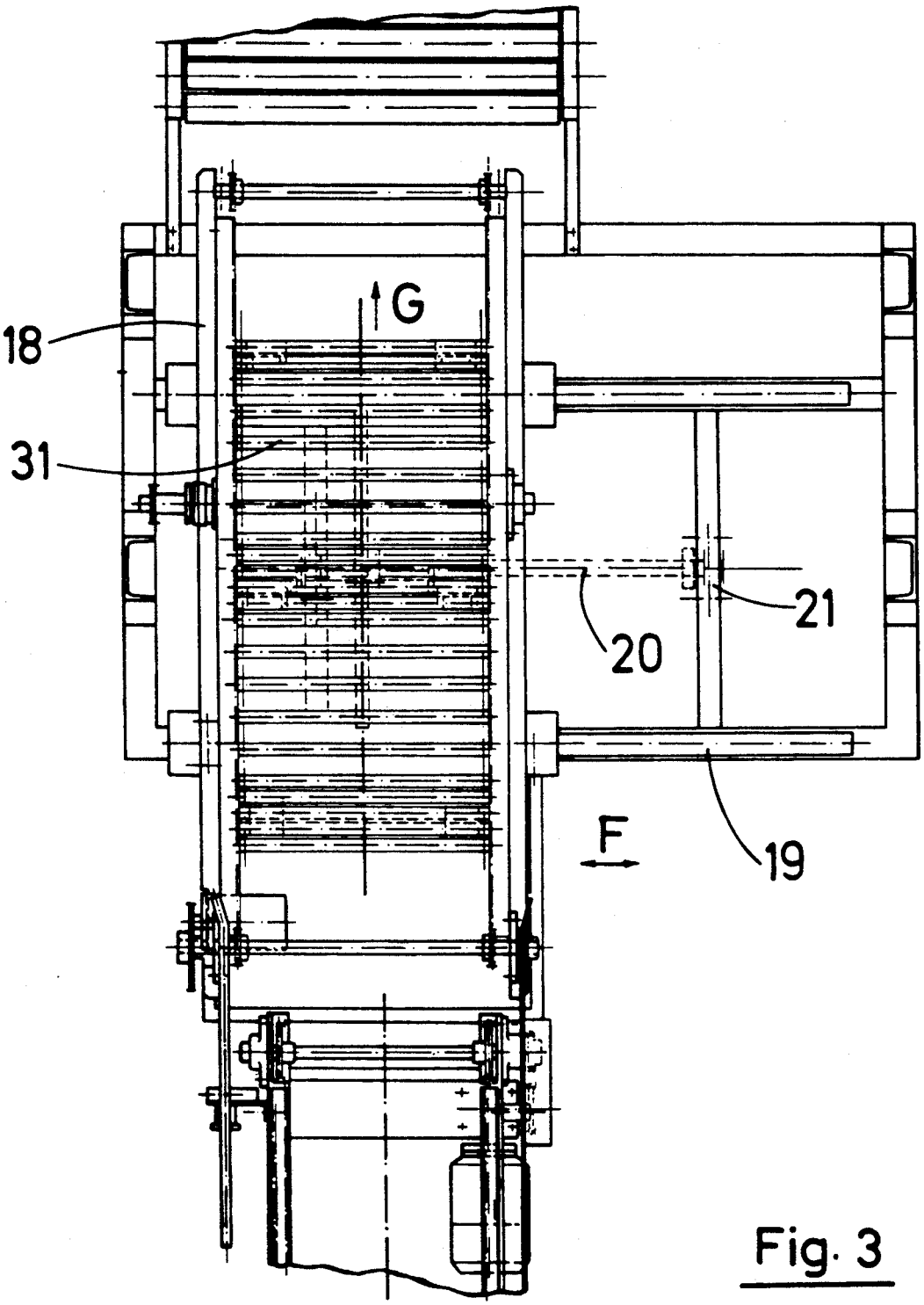
FIG. 3 is a plan view thereof.
Figure 4:
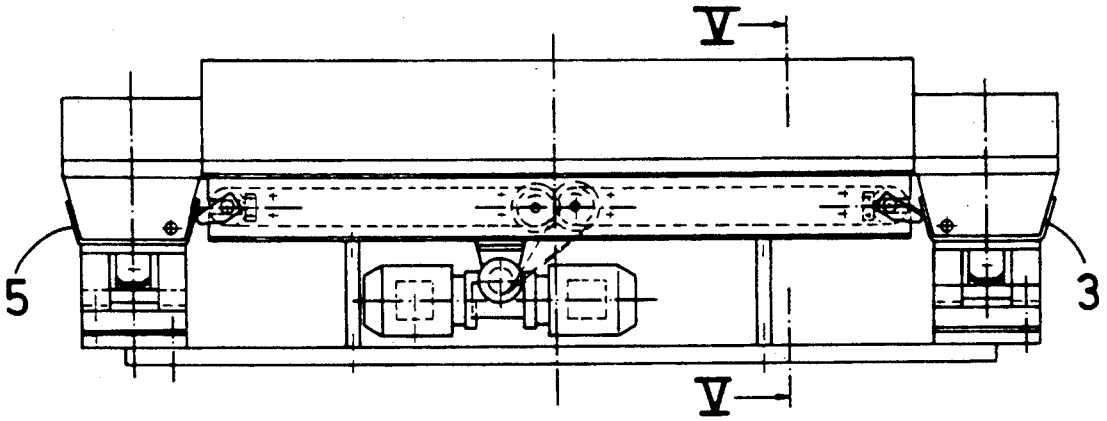
FIGS. 4, 5 and 6 represent, respectively, the product feed means in section along line IV—IV of FIG. 6, in section along line V—V of FIG. 4, and in plan view.
Figure 5:
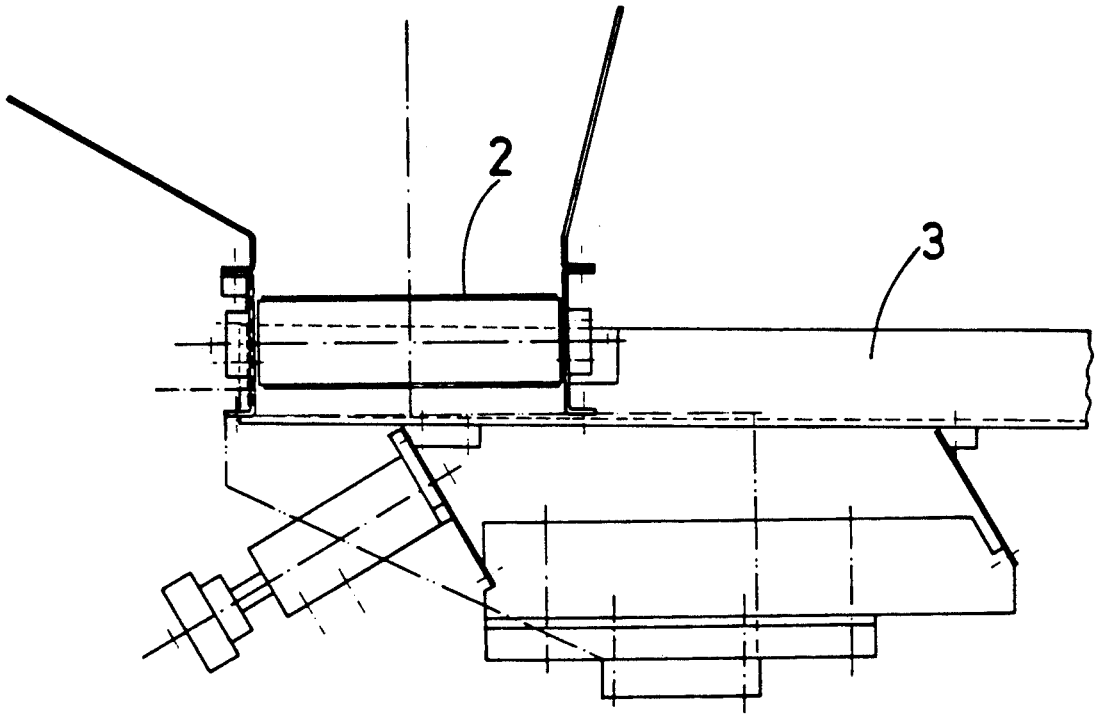
Figure 6:
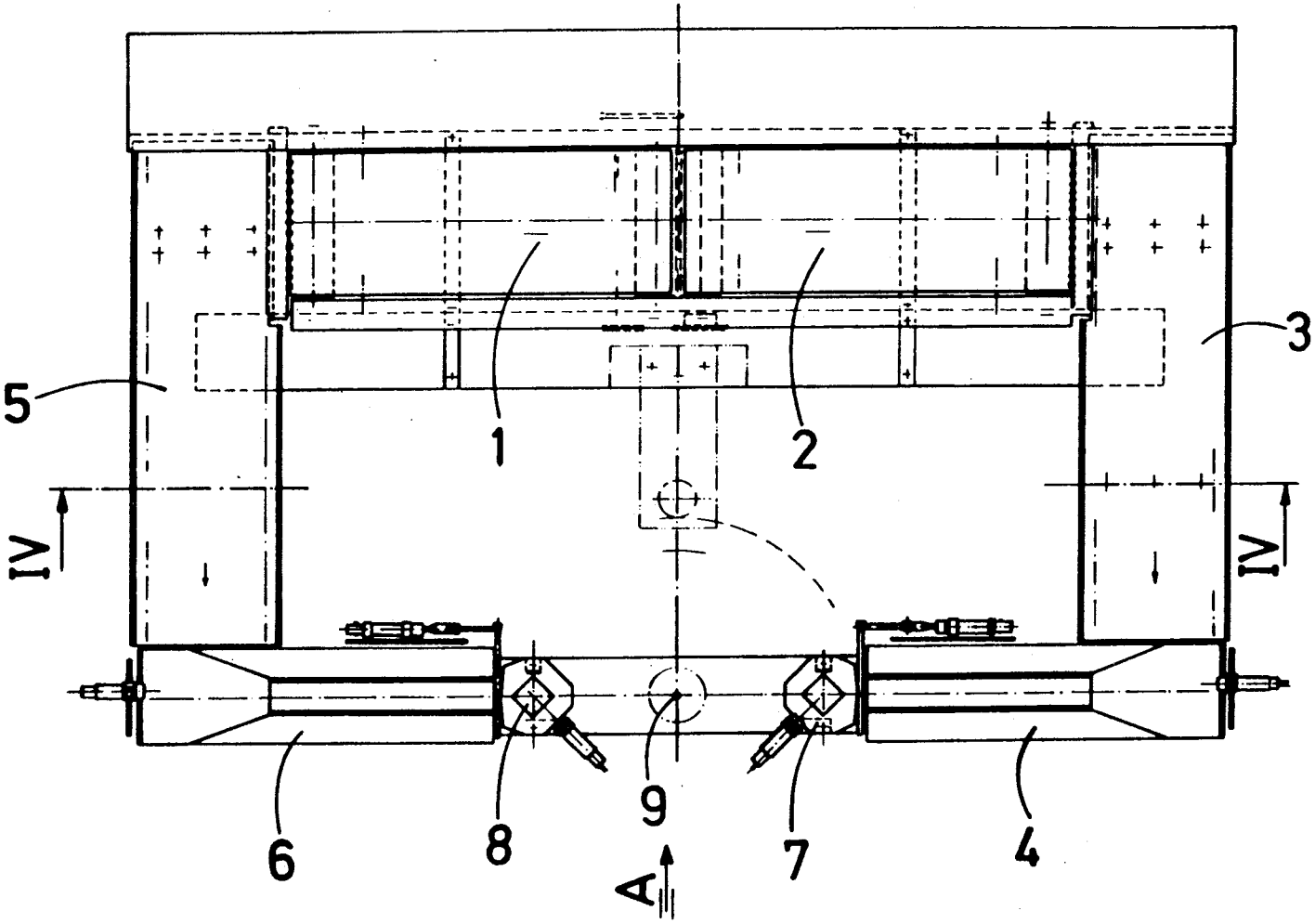

The containers that are disposed in a number equal to the number of independent rows, in this case two, are transported by transport means—FIGS. 1 to 3, 11 and 12— which, in this example, comprise a carriage (18) mounted on transverse rails such as the guide rail (19), for their displacement transverse to the longitudinal axis of the machine, said axis being considered in the direction and sense of the displacement of the containers to be filled from their entrance, when empty, to the machine to their exit when full, said longitudinal direction and sense being indicated by the arrow G and said transverse displacement by the arrow F, as shown in FIG. 3. The mentioned transverse displacement is alternating, that is, from left to right and back, as represented in FIG. 3, and it is obtained by means of the spindle (20) for example, driven clockwise or counterclockwise by the step mootor (21), with the respective bolts and nuts on the displaceable carriage itself, although such means of alternating transverse displacement could be any other suitable ones.

Figure 13:
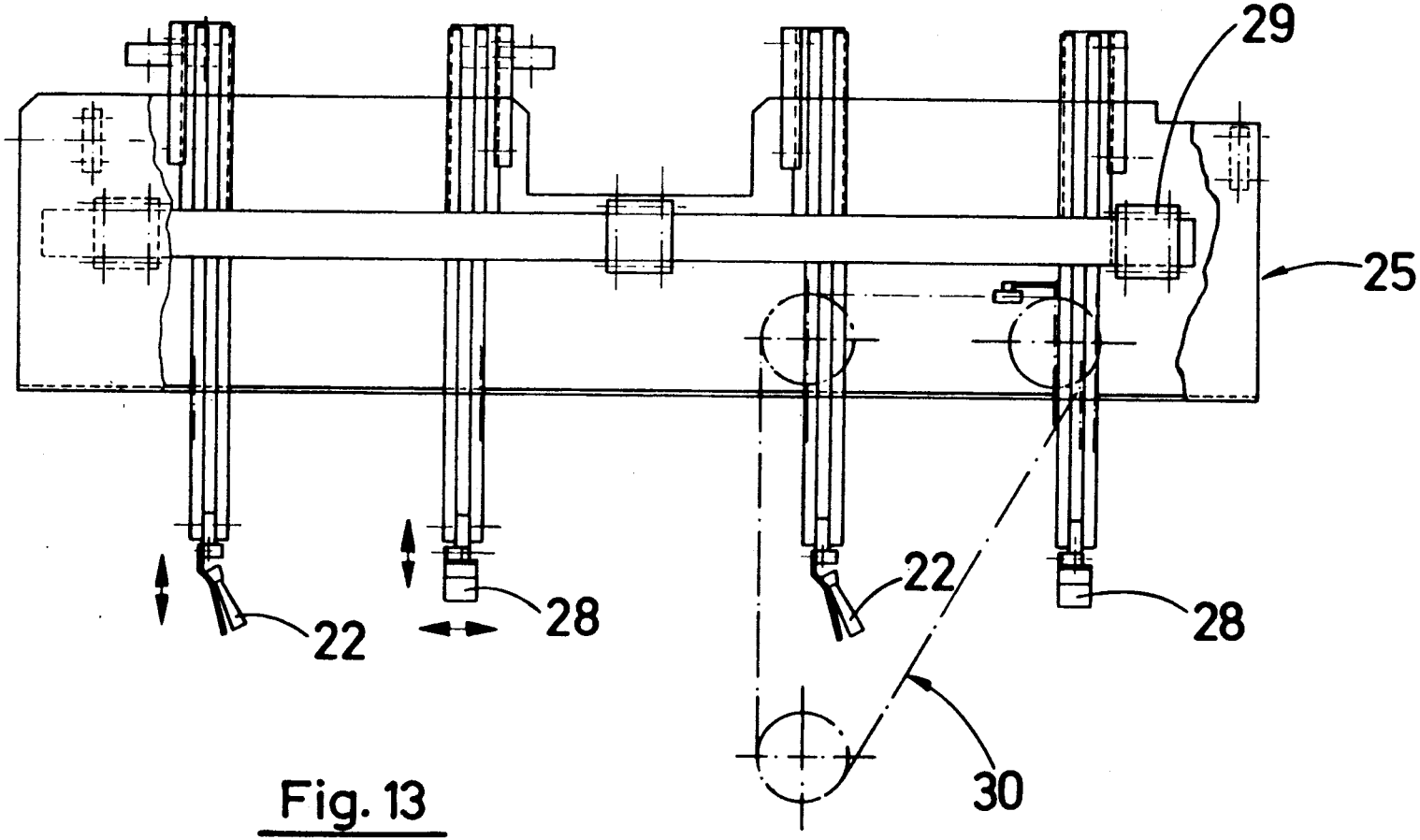
FIGS. 13, 14 and 15 represent the transverse barrier means and the means for holding the rows of products in elevation of the right side member, in front view and in plan view, respectively.
Figure 14:
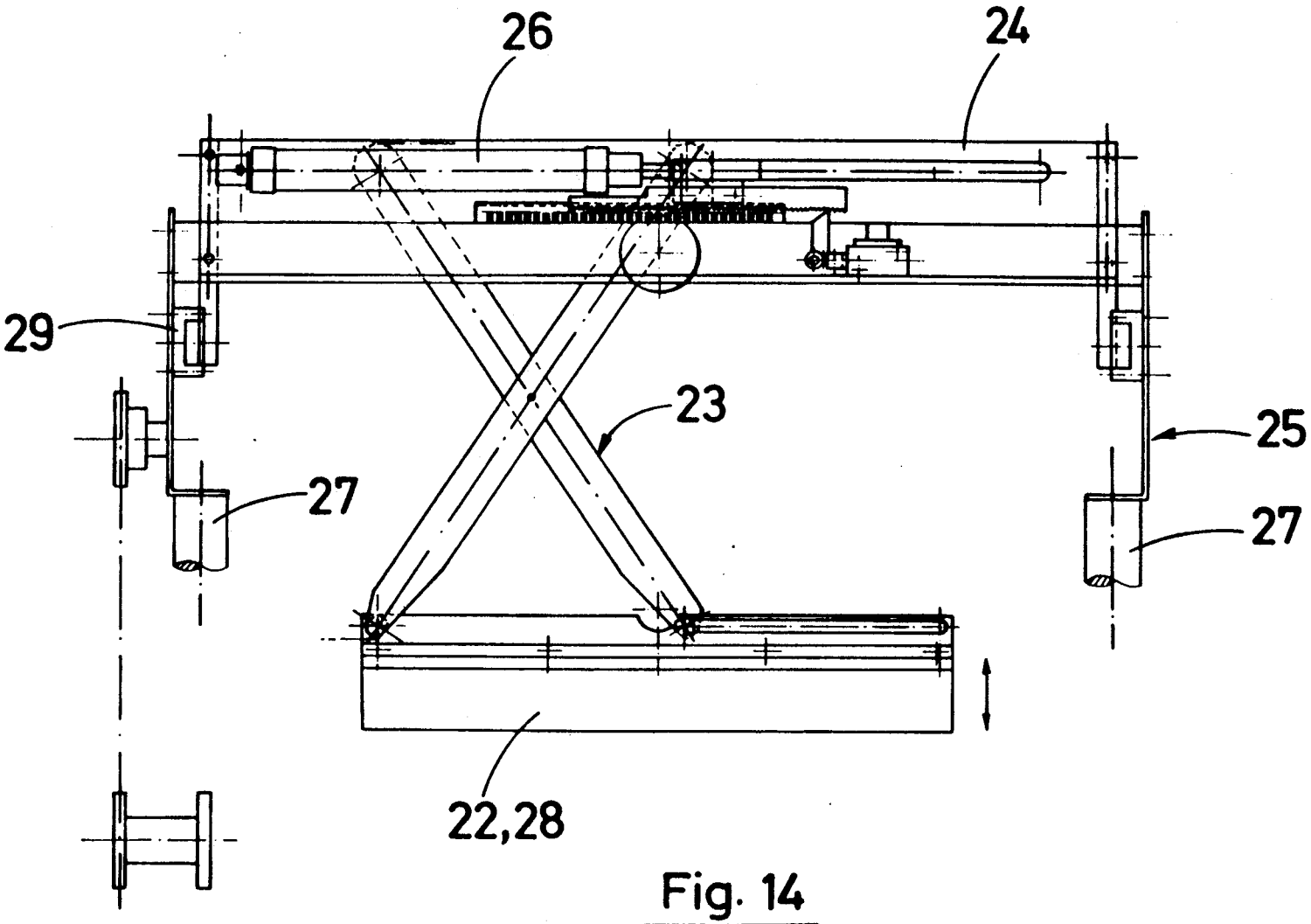
Figure 15:
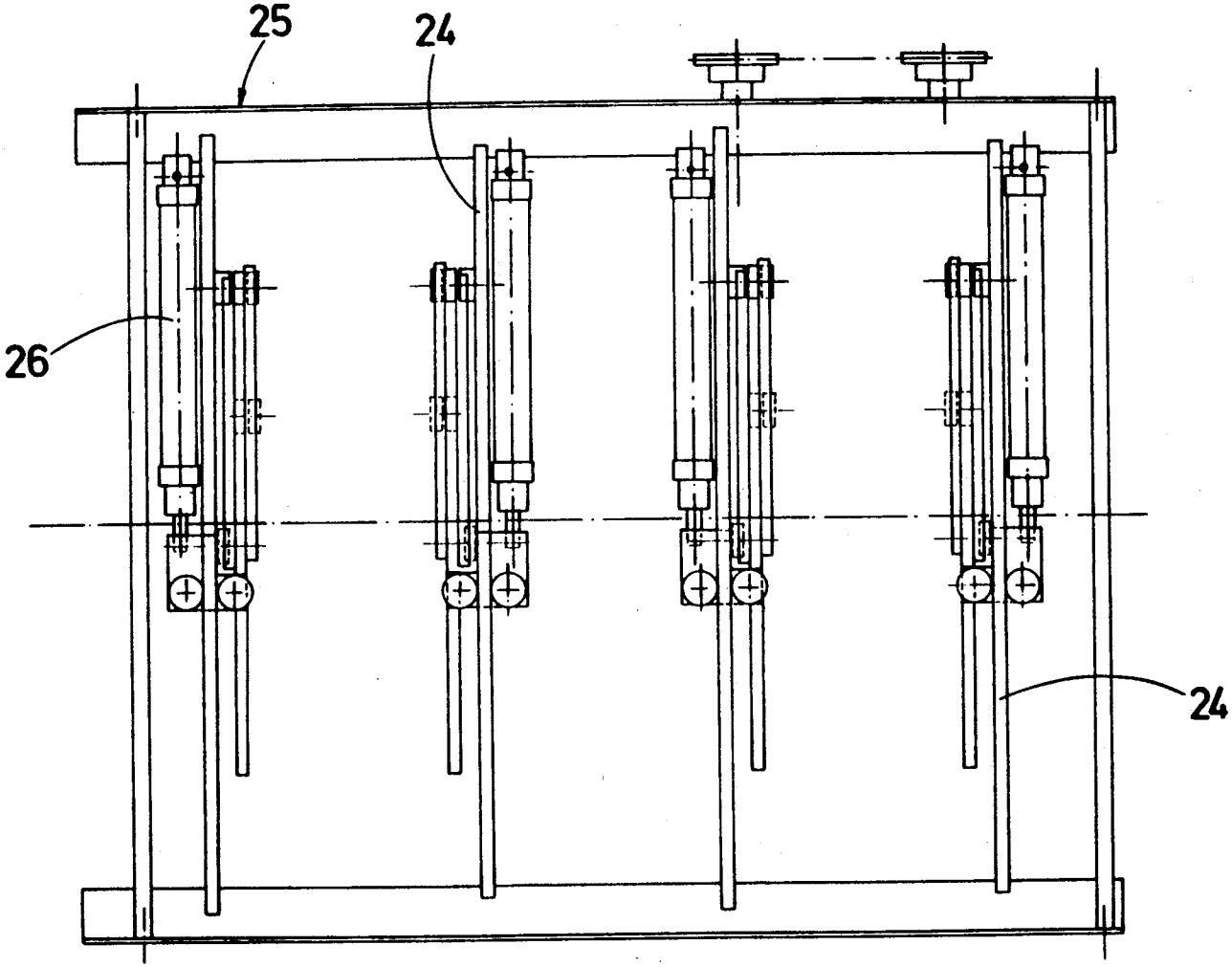

The container transporting means referred to convey the containers until they are brought under the respective discharge action of the—in this case—two products transported separately in space and simultaneously, by suction, by their transport means consisting of the rotating frame (11), whose pair of diametrically opposite suction cups, of the four which the frame comprises, descend unto the two containers and deposit each of the two products in each of said two containers; for which purpose there is placed inside each container a transverse barrier (22)—FIGS. 2 and 13 to 15— which are mounted for vertical upward and downward displacement—FIGS. 13 and 14— by means of a mechanism (23) articulated at the bottom to a support of the barrier and at the top to a fixed plate (not shown) of a chassis (25) to produce the lowering or raising of said barriers which, in their lower operative position, delimit the space necessary for composing each row of products, the first row being formed one by one simultaneously in each of the two containers and these being displaced, transversely and step by step, in the same direction as the row and in the sense suitable for continuing to form it until it is completed, by means of the corresponding displacement of the carriage (18). The two transverse barriers (22)—FIG. 13— are fastened to the chassis (25) which, in turn, is firmly connected to the carriage (18), for example by means of four vertical pillars such as (27)—FIGS. 2 and 14—, so that said chassis is parallel to the carriage and at a certain height above it.

Figure 11:
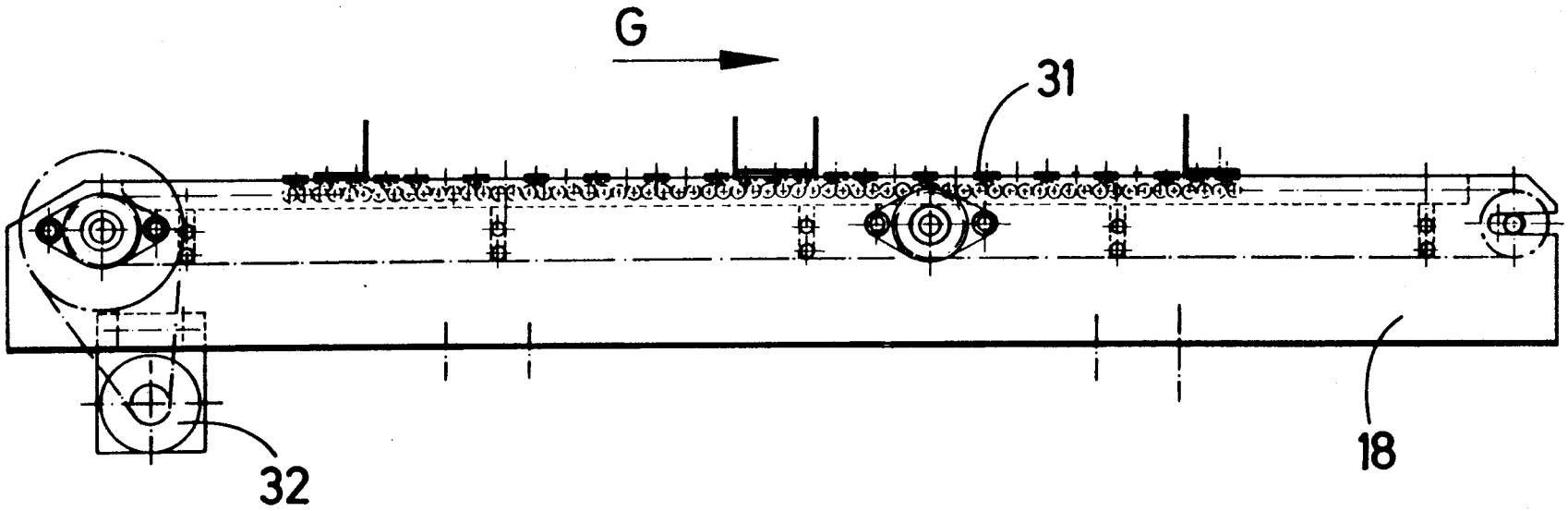
FIGS. 11 and 12 correspond to the container transporting means in an elevational view of the right side member and in a front view, respectively.

Said first row now completed is held immobilized relative to its corresponding container, its constraint being effected, in this example, owing to transverse holding means which in this case are two—one for each container—consisting of as many transverse holding strips (28)—FIG. 13—, which can press on the row of products formed in each of the juxtaposed containers, without damaging them, and which are mounted in the same manner as previously stated for the transverse barriers (22), but now these two holding strips (28) have means for their alternating longitudinal displacement relative to the chassis (25), and hence relative to the carriage (18), for which purpose the two holding means in question are joined together and mounted so that they can move longitudinally relative to the chassis (25), owing to guide means such as (29) —FIGS. 13 and 14—; and this alternating longitudinal displacement of the two transverse holding strips (28) is coordinated, with respect to the movement of the containers toward the exit, with the intermittent forward movement thereof when being filled, such displacement being equal to the separation between the axes of a product row already formed relative to the next one still to be formed, and to achieve this effect a suitable mechanism may be used which links the carriage (18) and the two holding strips (28) such as, in general, the mechanism (30), to which is fastened one of the two transverse holding means—the right-hand one in FIG. 13—, connected in turn to the other transverse holding means, which connection has not been shown in the drawings; and said mechanism is linked with at least one of the endless chains such as (31) of the carriage (18), to obtain a synchronized displacement of said pair of transverse holding means and of the container transporting means, see arrow G —FIGS. 3 and 11—; and in FIG. 14 is shown the plate (24) displaceable in the guide means (29) for each of the two transverse holding strips (28), making use of the same figure corresponding to the mounting of each of the transverse barriers (22).

Figure 12:
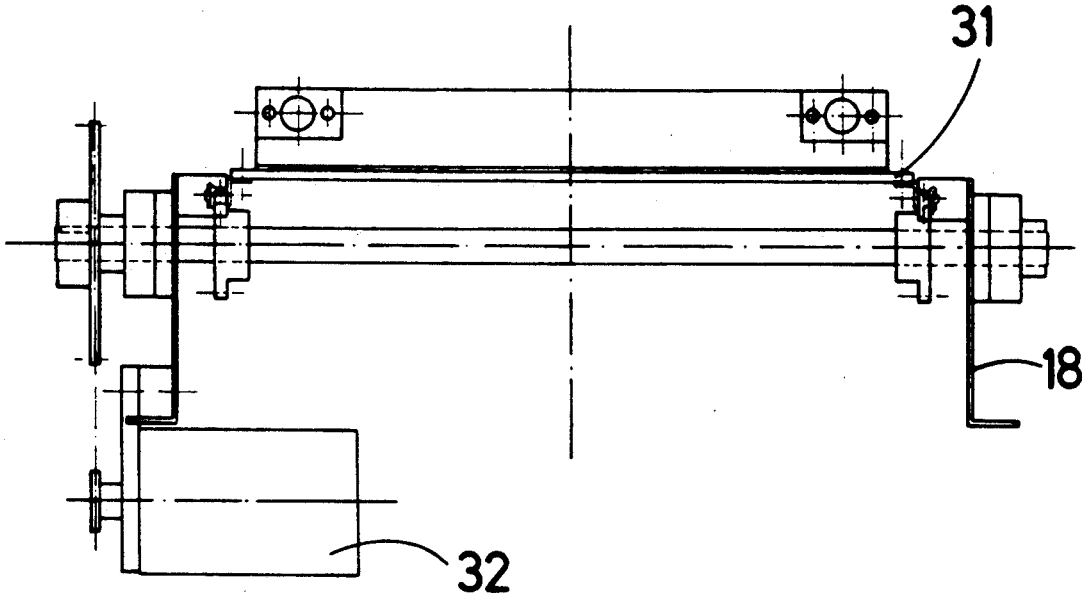

The container transporting means comprise, as has been stated, two endless chains (31), provided, over a part of their total development, with transverse container supporting slats, and with container retention stops whose length corresponds to the number of containers, in this case two, to be filled simultaneously in each complete cycle according to this process, and these two endless belts are actuated, through an appropriate transmission, by a step motor (32) —FIGS. 11 and 12—.

Once the first row is completed and immobilized relative to its corresponding container by means of the respective holding strip (28), the pair of containers containing their first row of products is made to advance longitudinally toward the exit, until said containers are again under the action of the aforesaid product discharges by the devices (12) of the frame (11), and the cycle repeats to form the second row, but with a transverse displacement of the containers, that is, of the carriage (18) with the means of longitudinal transport of the containers in a direction opposite to that of the preceding cycle, and after the second product row is completed, the constraint of the strips (28) on the first row is released and with said strips the respective second row formed in each container is constrained, and so forth until the corresponding layer of products is completed. When said first layer of products is completed, the operations described are repeated, if needed, for another layer or other superposed layers, raising the transverse barriers (22) and transverse holding means or holding strips (28) to the proper height, and after the two containers being handled are completely filled, they are transported to the exit of the machine in the direction and sense per arrow G —FIGS. 1, 3 and 11—, and possibly a conveyor (33) of empty containers is adapted opposite their entrance into the machine, as well as another conveyor (34), in this case a gravity type conveyor, for the pair of full containers at the exit of the machine.

The control and regulation of the various operative phases described, which includes different spatial distributions-to be selected by the user-of the products in the containers and in accordance with the capacity thereof, can be carried out by means of a process programming unit (35), which enables the user to select a distribution according to the length and width of the container for each layer and the relative distribution of layers to each other, taking into account the height of the container.

It should be noted that in the realization of the object of the present invention all variants of detail may be applied which experience and practice may suggest, particularly with respect to additional phases and other circumstances of an accessory nature, and any modifications of detail that are compatible with the essence of the process claimed may be introduced, as all this is comprised in the spirit of the following claims.

I claim:

1. A method for automatically filling a plurality of containers with products arranged therein in rows in one layer or a plurality of superposed layers in a preprogrammed geometric pattern comprising the steps of;

delivering empty containers in N rows to a corresponding container filling station for said N rows of containers, automatically transporting the products loaded from an element rotatable about a vertical axis to said container-filling station and loading them one-by-one onto N supports corresponding to the number of rows of containers, applying a vacuum suction to individual products on said supports and raising them higher than tops of the containers in relatively spaced and fixed relative positions, while said products are held raised effecting an angular rotation of the products jointly in said relatively spaced fixed relative positions preparatory for lowering and depositing the individual products in respective predetermined positions each in a given row within a corresponding container, simultaneously with the raising of products automatically positioning said containers by advancing incrementally the containers in said N rows at said product-filling station in a longitudinal direction corresponding to the longitudinal direction in which said rows are formed in respective containers and automatically moving the containers in said N rows at said product-filling station incrementally transversely of said direction to preprogrammed positions for positioning the individual containers of said N rows at said product-filling station to receive the products in proper positions in respective rows for forming said rows of any one layer in said pre-programmed geometric pattern, lowering vertically the raised products simultaneously into respective individual containers of said N rows at said product-filling station when the individual containers are in position to receive the products to define said rows therein in said pre-programmed geometric pattern, and inserting into each container barrier means to partition each row of products; cyclically repeating for additional rows the operations of delivery of empty containers for filling thereof at said product-filling station, transporting products to said supports, applying a vacuum suction to said products on said supports, raising upwardly said products while held by said vacuum suction, effecting said angular rotation, positioning incrementally said containers in said longitudinal direction, and transversely thereof to pre-programmed positions so the containers are in positions for receiving the products, lowering the products vertically into said containers, and repeating each of the said operations until the individual containers are filled at said product-filling station, and discharged from the filled containers therefrom.

2. The method according to claim 1, wherein the insertion into said containers of said barrier means being automatic while the containers are being filled to constrain the products in successively formed rows.

3. The method according to claim 1, in which N is two.

4. The method according to claim 1, in which each angular rotation at said product-filling station is a 90° angle.

* * * * *